US010053931B2

(12) United States Patent
Fischer et al.

(10) Patent No.: US 10,053,931 B2
(45) Date of Patent: Aug. 21, 2018

(54) DRIVE OF AN EARTH DRILLING DEVICE, EARTH DRILLING DEVICE, AND A METHOD FOR DRIVING AN EARTH DRILLING DEVICE

(71) Applicant: TRACTO-TECHNIK GmbH & Co. KG, Lennestadt (DE)

(72) Inventors: Sebastian Fischer, Lennestadt (DE); Stefan Hermes, Lennestadt (DE); Raimund Grobbel, Eslohe (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 206 days.

(21) Appl. No.: 14/957,015

(22) Filed: Dec. 2, 2015

(65) Prior Publication Data

US 2016/0160585 A1 Jun. 9, 2016

(30) Foreign Application Priority Data

Dec. 5, 2014 (DE) ..... 10 2014 018 100

(51) Int. Cl.
*E21B 19/083* (2006.01)
*E21B 6/02* (2006.01)
*E21B 7/04* (2006.01)

(52) U.S. Cl.
CPC ..... *E21B 19/083* (2013.01); *E21B 6/02* (2013.01); *E21B 7/046* (2013.01)

(58) Field of Classification Search
CPC ..... E21B 19/083
See application file for complete search history.

(56) References Cited

U.S. PATENT DOCUMENTS

| | | | | |
|---|---|---|---|---|
| 6,267,187 | B1 | 7/2001 | Puettmann et al. | |
| 8,671,626 | B1 | 3/2014 | Marty et al. | |
| 2008/0029262 | A1* | 2/2008 | Claxton | E21B 33/068 166/75.15 |
| 2010/0199812 | A1* | 8/2010 | Richardson | E21B 19/164 81/57.11 |
| 2010/0319999 | A1* | 12/2010 | Haughom | B66F 3/04 175/203 |
| 2013/0299189 | A1 | 11/2013 | Padira et al. | |

FOREIGN PATENT DOCUMENTS

| | | | |
|---|---|---|---|
| DE | 19715190 | C1 | 10/1998 |
| DE | 102009054183 | A1 | 11/2010 |
| EP | 0886034 | A2 | 12/1998 |
| GB | 2130682 | A | 6/1984 |
| WO | 2013/173101 | A2 | 11/2013 |

* cited by examiner

*Primary Examiner* — Giovanna Collins Wright
*Assistant Examiner* — Kristyn A Hall
(74) *Attorney, Agent, or Firm* — Howard IP Law Group, PC

(57) ABSTRACT

The invention relates to a drive of a slide of an earth drilling device having a rotary drive and a pinion that is driven by the rotary drive and can be engaged with a rack, wherein the rotary drive is engaged with another pinion which can be engaged with the rack.

17 Claims, 2 Drawing Sheets

DRIVE OF AN EARTH DRILLING DEVICE, EARTH DRILLING DEVICE, AND A METHOD FOR DRIVING AN EARTH DRILLING DEVICE

CROSS-REFERENCE TO RELATED APPLICATIONS

This application claims priority pursuant to 35 U.S.C. 119(a)-(d) to German Application No. 10 2014 018 100.6 filed Dec. 5, 2014, the subject matter incorporated herein by reference.

FIELD OF INVENTION

The invention relates to a drive of a slide of an earth drilling device having a rotary drive, an earth drilling device having such a drive, and a method for driving a slide of an earth drilling device having a rotary drive.

BACKGROUND

Earth drilling devices, in particular horizontal drilling devices, are used to introduce earth drill holes into the soil by trenchless construction for supply and waste lines, for example, or to replace already installed old lines without a trench. To introduce the earth drill hole, generally a drill string having drill string sections is used, wherein the drill string sections are connectable to each other.

The use of a slide that can be moved back and forth in a frame for advancing and/or retracting a drill string is known from EP 0 886 034 B1, for example. The slide has a seat for a drill string section such that the drill string section can be moved in the seat in the direction of a feed axis to create the earth drill hole. The drive acting on the drill string section can act on the drill string section in the seat in a rotational and/or translatory manner.

For driving the slide in the frame in a translatory manner, it is known to use a plurality of hydraulic motors for large and powerful earth drilling devices, said motors being used to drive the slide in the frame, i.e., for the back and forth movement. Each of the hydraulic motors can have a planetary gear which has a feed pinion that engages with a rack securely arranged in the frame and moves the slide in the frame, in particular in a translatory manner. For large and powerful earth drilling devices, it is therefore known to use more than one motor in order for example to be able to perform earth drilling in solid ground. The use of several motors means providing hydraulic connecting lines for each of the motors and providing a rack fastened to the frame for each of the motors. In addition, significant mechanical and hydraulic losses can result. Furthermore, the construction is relatively large.

SUMMARY

An object of the invention was therefore to create an improved drive of a slide of an earth drilling device having a rotary drive and a pinion driven by the rotary drive that improves at least one of the aforementioned disadvantages, that can also be built compactly in particular for large and powerful earth drilling devices, and can have low losses in efficiency. Furthermore, an earth drilling device with such a drive was to be created. A method for driving a slide of an earth drilling device with a rotary drive was to be created that improves the aforementioned disadvantages, in particular the expensive construction, many components, large construction and/or high losses in efficiency.

A key concept of the invention is to provide another pinion engaged with the rack which is driven indirectly or directly by the rotary drive like the first pinion engaged with the rack. Because of this, the power from a drive motor, i.e., the rotary drive which can have a gear, can be transmitted by two pinions to a rack. The use of two or more separate motors can be dispensed with. A compact construction results.

In an embodiment, the drive of a slide of an earth drilling device has a rotary drive. The rotary drive indirectly or directly drives a pinion which can be engaged with a rack. The rotary drive is engaged with another pinion which can be engaged with the rack. One and the same rotary drive directly or indirectly drives the pinion which can be engaged with the rack, as well as the other pinion. Both pinions are driven indirectly or directly by one and the same rotary drive.

An "earth drilling device" is in particular understood to be any device that moves a drill string having drill string sections within a channel that exists or is to be created in the soil in order to create or expand a hole, in particular a horizontal drill hole (HD), or to pull lines or other long bodies into the soil. The earth drilling device can in particular be an HD device. An "earth drilling device" according to the invention comprises a device that drives a drill string and works by displacing soil, and introduces the drill string into the soil in a rotating and/or translatory manner in the direction of the longitudinal axis of the drill string.

According to the present invention, the term "HD" (horizontal drilling) comprises in particular any type of preferably horizontal channels in a body that exist or are to be created, in particular earth channels including earth drill holes, rock drill holes or ground lines as well as underground or above-ground pipelines and water channels that can be produced or pulled in by using a corresponding earth drilling device.

With regard to the subsequently referenced noun, the term "at least one" used in the claims or the description, as well as the indefinite article "a" used in the claims or the description, and the corresponding grammatical forms in terms of gender and declension, are precisely one or more, i.e., two, three, four, etc. of the elements designated by the noun.

According to the invention, the term "slide" indicates a body with a seat for a drill string section, wherein the drill string section can be driven in a translatory and/or rotating manner by means of the drill string section seat. In particular, the slide within the frame can be guided along a path for a translatory movement. The slide can lie on a support that is connected to the frame and has resting elements. The support can be profiled, and the resting elements can be designed as rollers. Skids are also possible as the resting elements. The slide can be guided suspended and/or lying on the frame. The slide can thus be a machine element that can be moved along a path, in particular in a purely translatory manner, within the frame.

According to the invention, the term "frame" comprises a box-shaped or cube-shaped structure whose side walls and/or braces or rods can transfer pressure, traction as well as bending. The frame according to invention preferably has a rectangular outline and can be arranged in a trench for creating the earth drill hole. The frame can however also be a frame which can be arranged above ground, i.e., above the soil. Preferably, the drive unit and slide are arranged in the frame. In order to fix the device in the trench, the frame can be provided with horizontally extendable braces by means of which the recoil forces can be conducted into the soil.

The pinion engaged with the rack can be arranged directly on the shaft of the rotary drive so that the pinion engaged with the rack is driven directly by the rotary drive. The other pinion which engages with the rack can be driven indirectly, that is, by a third pinion which is inserted between the two pinions and engages with the two pinions which engage with the rack. The rotary drive can also directly drive a pinion which is not engaged with the rack in that the pinion is arranged directly on the shaft of the rotary drive. For their part, the pinions engaged with the rack engage with the pinion of the rotary drive seated on the shaft.

In one preferred embodiment, the rotary drive has a drive pinion engaged with both pinions such that the two pinions engage with one and the same drive pinion, and forced guidance of the two pinions is possible by means of the one drive pinion. As described above, the rotary drive can also be directly connected to one of the pinions which are engaged with the rack in that a pinion engaged with the rack is inserted on the shaft of the rotary drive and is thus driven directly by the rotary drive.

Preferably, the rotary drive and the two pinions are mounted on a flat structure which can be a component of the slide. The flat structure can for example be a support surface of the slide.

In one preferred embodiment, the two pinions rotate in the same direction. The two pinions can thus roll simultaneously on the rack in the same direction of movement and thereby cause the slide to move.

In one preferred embodiment, the two pinions are designed with helical teeth, hence there are always two or more teeth simultaneously in contact when there are helical pairs of toothed wheels between the drive pinion of the rotary drive and the pinion engaged with the rack. Less forceful impact can arise when teeth of the helical pinion engage, wherein the drive pinion of the rotary drive can also have helical teeth, which leads to reduced vibrational excitation. The formed tooth root strength and pitting resistance can be greater. With helical teeth, the pairing between the helical teeth pinion and drive pinion of the rotary drive does not directly contact across its entire width; instead, the width of teeth subject to a load slowly increases as the relevant wheels rotate further until the pair of teeth bear over the entire width, and slowly decreases upon rotating out of the contact zone.

In one preferred embodiment, the two pinions are arranged symmetrically to the rotary drive. The two pinions are symmetrical to a drive pinion of the rotary drive with respect to a middle axis through the drive pinion which is perpendicular to the longitudinal axis of the rack.

In one preferred embodiment, the rotary drive has a hydraulic motor so that an economical central drive unit can be created.

Preferably, the rotary drive comprises a planetary gear which is a compactly constructed gear in which the input shaft and output shaft are aligned with each other.

The invention also creates an earth drilling device with a drive designed according to the previous embodiments, wherein the earth drilling device has a frame and a rack fastened to the frame. Together with the slide, the drive moves relative to the immobile rack on the frame.

Furthermore, the invention creates a method for driving a slide of an earth drilling device with a rotary drive, wherein the rotary drive engages with a pinion that engages with a rack. According to the method according to the invention, another pinion is driven by means of the rotary drive and is engaged with the rack, and a force is exerted on the rack by means of the additional pinion.

The above statements, and likewise the following description of exemplary embodiments, do not constitute a relinquishment of specific embodiments or features.

BRIEF DESCRIPTION OF THE DRAWINGS

The invention is explained in greater detail below based on an exemplary embodiment shown in the drawings.

In the drawings.

DETAILED DESCRIPTION OF PREFERRED EMBODIMENTS

Figure 1:
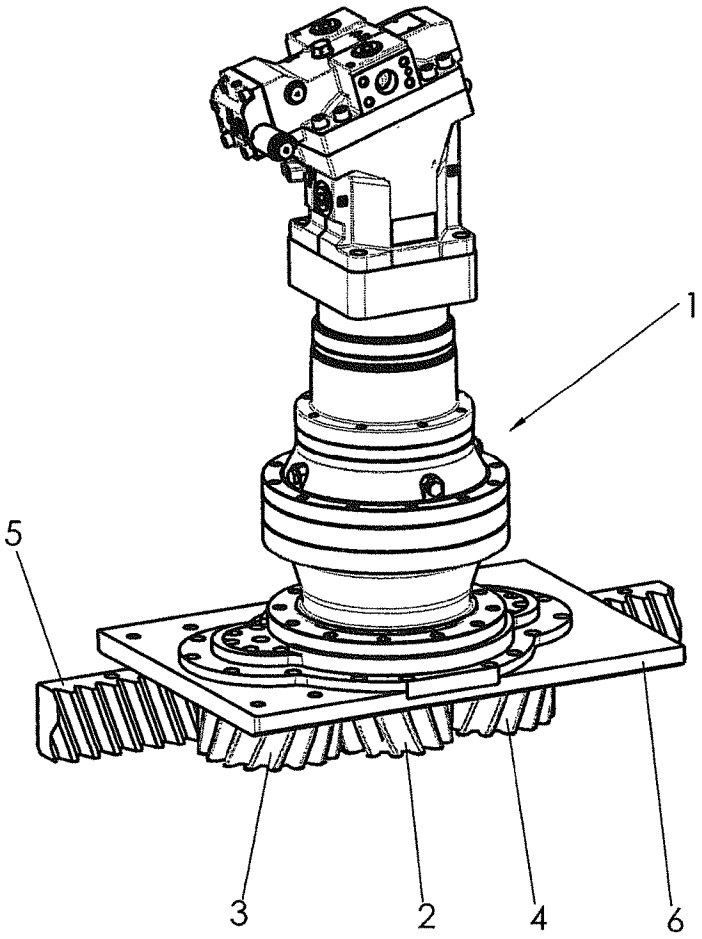
FIG. 1 shows a schematic isometric representation obliquely from above of a drive for a slide of an earth drilling device with a rack.

FIG. 1 shows a drive of a slide of an earth drilling device. The drive has a rotary drive 1 and a pinion 3 that is indirectly driven by the rotary drive 1 and engages with a rack 5 which can be securely connected to a frame of an earth drilling device. The drive furthermore has another pinion 4 that is also engaged with the rack 5.

The two pinions 3, 4 are thus engaged with the rack 5, and the rotary drive 1 can be moved along the rack by rotating the pinions 3 and 4 relative to the rack 5 in a translatory manner along the extension of the rack 5. The pinions 3 and 4 are engaged with a drive pinion 2 of the rotary drive 1.

The two pinions 3 and 4 are mounted on a flat structure 6. The two pinions 3 and 4 rotate in the same direction and have the same dimensions. The two pinions 3 and 4 and the drive pinion 2 have helical teeth.

The two pinions 3 and 4 are arranged symmetrically to the drive pinion 2 on the rack 5. In the embodiment depicted in FIGS. 1 and 2, the rotary drive 1 is designed as a hydraulic motor and comprises a planetary gear.

Figure 2:
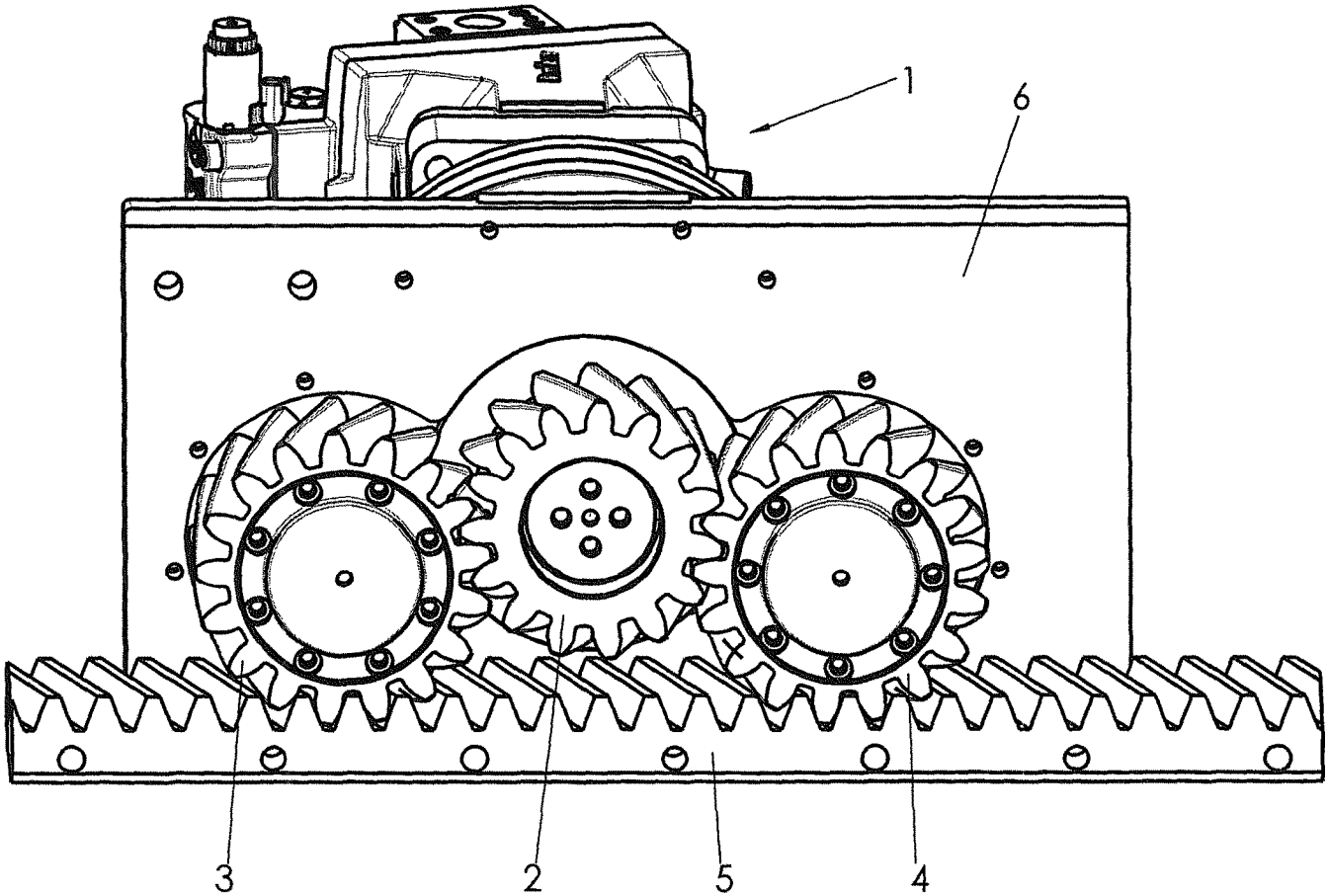
FIG. 2 shows the representation from FIG. 1 in an isometric representation obliquely from below.

FIG. 2 shows the two engaged pinions 3, 4 and the drive pinion 2 with the rack 5 in a view from below.

The invention claimed is:

1. An apparatus configured to drive a slide of an earth drilling device, the apparatus comprising:

a rotary drive;

a first pinion driven by the rotary drive and configured for engaging with a rack; and a second pinion driven by the rotary drive and configured for engaging with the rack, wherein a rotational axis of the rotary drive is oriented generally parallel with rotational axes of the first and second pinions, and arranged at a fixed first distance from the rack in a first direction generally perpendicular to a direction of elongation of the rack, and wherein the rotational axis of at least one of the first pinion and second pinion is arranged at a second distance from the rack, distinct from the first distance, in a second direction, parallel to the first direction, and generally perpendicular to the direction of elongation of the rack.

2. The apparatus of claim 1, wherein the rotary drive has a drive pinion directly engaged with the first and second pinions.

3. The apparatus of claim 1, wherein the rotary drive is fixedly mounted on a flat structure.

4. The apparatus of claim 1, wherein the first and second pinions are configured to rotate in the same direction.

5. The apparatus of claim 1, wherein the first and second pinions have helical teeth.

6. The apparatus of claim 1, wherein the first and second pinions are arranged symmetrically to the rotary drive.

7. The apparatus of claim 1, wherein the rotary drive comprises a hydraulic motor.

8. The apparatus of claim 1, wherein the first distance is greater than the second distance.

9. The apparatus of claim 1, wherein the rotational axis of each of the first pinion and the second pinion is arranged at the second distance from the rack.

10. An earth drilling device comprising:

a frame;

a rack securely connected to the frame; and a drive assembly comprising:

a rotary drive securely connected to the frame;

a first pinion driven by the rotary drive and configured for engaging with the rack; and a second pinion driven by the rotary drive and configured for engaging with the rack, wherein a rotational axis of the rotary drive is arranged at a first distance from the rack in a first direction generally perpendicular to a direction of elongation of the rack, and wherein rotational axes of the first pinion and the second pinion are arranged at a second distance from the rack, distinct from the first distance, in a second direction, parallel to the first direction, and generally perpendicular to the direction of elongation of the rack, and wherein rotation of the rotary drive causes movement of a slide within the frame.

11. The device of claim 10, further comprising a drive pinion connected to the rotary drive and directly engaged with the first and second pinions.

12. The device of claim 10, wherein the first distance is greater than the second distance.

13. The device of claim 10, wherein the rotational axis of the rotary drive is oriented generally parallel with the rotational axes of the first and second pinions.

14. A method for driving a slide of an earth drilling device having a rotary drive defining a rotational axis arranged at a first distance from a rack in a first direction generally perpendicular to a direction of elongation of the rack, comprising:

driving, with the rotary drive, a first pinion which engages with a rack, wherein a rotational axis of the first pinion is arranged at a second distance from the rack, distinct from the first distance, in a second direction, parallel to the first direction, and generally perpendicular to the direction of elongation of the rack; and driving, with the rotary drive, a second pinion which engages with the rack, wherein a rotational axis of the second pinion is arranged at the second distance from the rack, in a third direction, parallel to the first direction, and generally perpendicular to the direction of elongation of the rack.

15. The method of claim 14, wherein a drive pinion attached to the rotary drive directly engages with the first and second pinions.

16. The method of claim 14, wherein the first distance is greater than the second distance.

17. The method of claim 14, wherein the rotational axis of the rotary drive is oriented generally parallel with the rotational axes of the first and second pinions.

* * * * *